US012538947B1

(12) United States Patent
Brown

(10) Patent No.: US 12,538,947 B1
(45) **Date of Patent: *Feb. 3, 2026**

(54) ADJUSTABLE INTRA-CLOTHING DEVICE FOR SUPPORTING AT LEAST A PORTION OF A TORSO OF A PERSON, AN ARTICLE OF CLOTHING FOR SUPPORTING AT LEAST A PORTION OF A TORSO OF A PERSON, AND AN ADJUSTABLE CORSET FOR SUPPORTING AT LEAST A PORTION OF A TORSO OF A PERSON

(71) Applicant: A'sha Brown, Berwyn, PA (US)

(72) Inventor: A'sha Brown, Berwyn, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/819,047

(22) Filed: Aug. 29, 2024

Related U.S. Application Data

(63) Continuation of application No. 17/984,345, filed on Nov. 10, 2022, now Pat. No. 12,102,139.

(60) Provisional application No. 63/282,275, filed on Nov. 23, 2021.

(51) Int. Cl.

| | |
|---|---|
| ***A41C 1/02*** | (2006.01) |
| ***A41C 1/12*** | (2006.01) |
| ***A41F 1/04*** | (2006.01) |

(52) U.S. Cl.
CPC ..... *A41C 1/02* (2013.01); *A41C 1/12* (2013.01); *A41F 1/04* (2013.01); *A41D 2400/38* (2013.01)

(58) Field of Classification Search
CPC ..... A41C 1/02; A41C 1/12
See application file for complete search history.

(56) References Cited

U.S. PATENT DOCUMENTS

| | | | | |
|---|---|---|---|---|
| 880,736 | A | 3/1908 | Hoskins | |
| 2,663,025 | A | 12/1953 | Siegfried | |
| 3,185,158 | A | 5/1965 | Gattuso | |
| 4,025,374 | A | 5/1977 | Spindler | |
| 5,157,790 | A * | 10/1992 | Aldridge | A41D 13/0531 2/81 |
| 6,146,240 | A | 11/2000 | Morris | |
| 6,513,169 | B1 | 2/2003 | Meijide Garcia | |
| 6,883,179 | B1 | 4/2005 | Crum | |
| 7,765,619 | B2 | 8/2010 | Jaccard | |
| D728,804 | S | 5/2015 | Hansen | |
| 9,717,283 | B1 | 8/2017 | McCalla | |
| D906,630 | S | 1/2021 | Lin | |
| 11,213,083 | B2 | 1/2022 | Patton | |
| 12,102,139 | B1 * | 10/2024 | Brown | A41F 1/04 |
| 2008/0017496 | A1 | 1/2008 | Thompson | |
| 2008/0244805 | A1 | 10/2008 | Griffin | |
| 2015/0015030 | A1 | 1/2015 | Sasaki et al. | |
| 2015/0208734 | A1 | 7/2015 | Callahan | |
| 2016/0143765 | A1 * | 5/2016 | Blake | A61F 5/02 602/19 |
| 2019/0313722 | A1 * | 10/2019 | Liu | A41D 13/1245 |

(Continued)

*Primary Examiner* — Gloria M Hale
(74) *Attorney, Agent, or Firm* — THE GARCIA-ZAMOR LAW FIRM; Ruy Garcia-Zamor

(57) ABSTRACT

An adjustable intra-clothing device for supporting at least a portion of the torso of a person that may be free of any boning. An article of clothing for supporting at least a portion of a torso of a person that may conform to the natural curvature of the torso of the person. An adjustable corset for supporting at least a portion of a torso of a person that may provide a compressive force around the torso of the person.

20 Claims, 7 Drawing Sheets

(56) References Cited

U.S. PATENT DOCUMENTS

| | | | | |
|---|---|---|---|---|
| 2021/0228395 | A1* | 7/2021 | Lugo-Alayon .... | A41D 13/0525 |
| 2022/0132940 | A1 | 5/2022 | Beard | |
| 2023/0016986 | A1 | 1/2023 | Carlson | |

* cited by examiner

ADJUSTABLE INTRA-CLOTHING DEVICE FOR SUPPORTING AT LEAST A PORTION OF A TORSO OF A PERSON, AN ARTICLE OF CLOTHING FOR SUPPORTING AT LEAST A PORTION OF A TORSO OF A PERSON, AND AN ADJUSTABLE CORSET FOR SUPPORTING AT LEAST A PORTION OF A TORSO OF A PERSON

CROSS-REFERENCE TO RELATED APPLICATIONS

This application claims priority to and benefit of U.S. patent application Ser. No. 17/984,345, filed Nov. 10, 2022, which claims priority to U.S. Provisional Patent Application 63/282,275, filed Nov. 23, 2021, each of which is hereby incorporated by reference in its entirety as if fully set forth herein.

BACKGROUND

The preferred embodiments of the present invention relate generally to clothing and shapewear. More specifically, the preferred embodiment of the present invention relates to an adjustable intra-clothing device and an adjustable corset.

Typically, there have been limited options for people using supporting and body sculpting undergarments. This has reduced the number of possible activities that can be enjoyably pursued with such devices. Typical corsets require rigid boning material for providing support and sculpting as well as complicated lacing systems for tightening the corset.

Therefore, it may be advantageous to provide an adjustable intra-clothing device for supporting at least a portion of a torso of a person, an article of clothing for supporting at least a portion of a torso of a person, and an adjustable corset for supporting at least a portion of a torso of a person which may, but does not necessarily, provide: an improved corset for providing support and body sculpting without boning; an easy to use corset that can be donned without assistance; a support and body sculpting system that is easily concealable under and/or within clothing and dresses; an adjustable intra-clothing device for supporting and shaping a person's torso; a dress or other article of clothing with an adjustable, built-in corset; an adjustable intra-clothing device for supporting and shaping a person's torso which is free of any boning; a dress or other article of clothing with an adjustable, built-in corset which is free of any boning; a corset which is free of any boning; a corset where each of the supporting elements are independently adjustable; and/or a corset where each of the supporting elements may contour and shape a person's torso according to the natural curvature of the person's body.

SUMMARY

Briefly speaking, one embodiment of the present invention is directed to an adjustable intra-clothing device for supporting at least a portion of a torso of a person.

In a separate embodiment, the present invention is directed to an article of clothing for supporting at least a portion of a torso of a person.

In a separate embodiment, the present invention is directed an adjustable corset for supporting at least a portion of a torso of a person.

In a separate aspect, the present invention is directed to an adjustable intra-clothing device for supporting at least a portion of a torso of a person. The device may comprise a supporting sleeve configured to wrap around the torso of the person. The device may further comprise a plurality of support straps. The plurality of support straps may be connected to an exterior of the supporting sleeve and may be configured to at least partially wrap around the torso of the person. The plurality of straps may be parallel to one another and may be evenly vertically spaced from one another. Each of the plurality of support straps may have a first end and a second end. Each of the plurality of support straps may be configurable in a first, non-supporting position in which the first end is detached from the second end and may be configurable in a second, supporting position in which the first end is engaged with the second end.

In a separate aspect, the present invention is directed to an adjustable intra-clothing device for supporting at least a portion of a torso of a person. The device may comprise a plurality of support straps connected to an exterior of the supporting sleeve. Each of the plurality of support straps may have a first end and a second end. The first end of each of the plurality of support straps may be configured to partially overlap the second end the plurality of straps are in the second, supporting position.

In a separate aspect, the present invention is directed to an adjustable intra-clothing device for supporting at least a portion of a torso of a person. The device may comprise a plurality of support straps connected to an exterior of the supporting sleeve. Each of the plurality of support straps may have a first end and a second end. The first end may comprise a first connecting member and the second end may comprise a plurality of second connecting members. The first connecting member may be configured for engagement with any one of the plurality of second connecting members to convert each of the plurality of straps to the second, supporting position. The engagement of the first and second connecting members may prevent relative movement between the first and second ends.

In a separate aspect, the present invention is directed to an adjustable intra-clothing device for supporting at least a portion of a torso of a person. The device may comprise a plurality of support straps connected to an exterior of the supporting sleeve. Each of the plurality of support straps may have a first end and a second end. The first connecting member may comprise a hook and the plurality of second connecting members may comprise loops. The hook may be configured to be engaged with any of the loops.

In a separate aspect, the present invention is directed to an adjustable intra-clothing device for supporting at least a portion of a torso of a person. The device may comprise a plurality of support straps connected to an exterior of the supporting sleeve. Each of the plurality of support straps may be made of an elastic material such that each of the plurality of support straps can be stretched and tightened around the torso of the person when each of the plurality of support straps may be converted from the first, non-supporting position to the second, supporting position.

In a separate aspect, the present invention is directed to an adjustable intra-clothing device for supporting at least a portion of a torso of a person. The device may comprise a plurality of support straps connected to an exterior of the supporting sleeve. Each of the plurality of support straps may be adjusted to a desired length and tightness independent from each of the other of the plurality of support straps when each of the plurality of straps may be converted from the first, non-supporting position to the second, supporting position.

In a separate aspect, the present invention is directed to an adjustable intra-clothing device for supporting at least a portion of a torso of a person. The device may removably insertable into, and free-floating within, a lining of an article of clothing. Free floating may mean that the device can slide up and down within the clothing such that the vertical position of the device relative to the height of the article of clothing can be freely adjusted.

In a separate aspect, the present invention is directed to an adjustable intra-clothing device for supporting at least a portion of a torso of a person. The device may be permanently sewn into a lining of an article of clothing.

In a separate aspect, the present invention is directed to an adjustable intra-clothing device for supporting at least a portion of a torso of a person. The device may be concealable within the lining of the article of clothing by engaging a zipper on a back of the article of clothing.

In a separate aspect, the present invention is directed to an adjustable intra-clothing device for supporting at least a portion of a torso of a person. The adjustable intra-clothing device may be free of any boning.

In a separate aspect, the present invention is directed to an adjustable intra-clothing device for supporting at least a portion of a torso of a person. The adjustable intra-clothing device may be free of any boning. The adjustable intra-clothing device may also be free of any lacing for tightening and securing the device in the second, supporting position.

In a separate aspect, the present invention is directed to an adjustable intra-clothing device for supporting at least a portion of a torso of a person. The device may comprise a plurality of support straps connected to an exterior of the supporting sleeve. The plurality of straps may be elastic such that the compressive force provided by the adjustable intra-clothing device can be entirely provided by the elasticity of the plurality of straps and not due to the tightening of a non-elastic band which may be fixed in position around the person.

In an alternative preferred embodiment, the present invention is directed to an article of clothing for supporting at least a portion of a torso of a person. The article of clothing may comprise an outer clothing layer and an inner clothing layer. The inner clothing layer may form a lining. The outer and inner clothing layers may form a cavity located therebetween. The article of clothing may also comprise a plurality of support straps connected directly to or within the lining and contained within the cavity. The plurality of support straps may be configured to at least partially wrap around the torso of the person. The plurality of straps may also be parallel to one another and evenly vertically spaced from one another. Each of the plurality of support straps may have a first end and a second end. Each of the plurality of support straps may be configurable in a first, non-supporting position in which the first end is detached from the second end and may be configurable in a second, supporting position in which the first end is engaged with the second end.

In an alternative preferred embodiment, the present invention is directed to an article of clothing for supporting at least a portion of a torso of a person. The article of clothing may comprise an outer clothing layer and an inner clothing layer. The article of clothing may further comprise an internal layer. The internal layer may be located between the outer clothing layer and the inner clothing layer. The internal layer may cover the plurality of straps. The internal layer may be sewn to the inner clothing layer in spaces located between each of the plurality of straps.

In an alternative preferred embodiment, the present invention is directed to an adjustable corset for supporting at least a portion of a torso of a person. The corset may comprise a body support sleeve configured to encircle the torso of the person wearing the corset. The corset may also comprise a plurality of support straps connected to an exterior of the body support sleeve. The plurality of support straps may be configured to at least partially wrap around the torso of the person. The plurality of straps may be parallel to one another and evenly vertically spaced from one another. Each of the plurality of support straps may be configurable in a first, non-supporting position in which the first end is detached from the second end and may be configurable in a second, supporting position in which the first end is engaged with the second end.

In an alternative preferred embodiment, the present invention is directed to an adjustable corset for supporting at least a portion of a torso of a person. The corset may be configured to be worn under an article of clothing such that the corset is concealed from view.

In an alternative preferred embodiment, the present invention is directed to an adjustable corset for supporting at least a portion of a torso of a person. The corset may support and sculpt the torso of the person to the person's desired figure.

In an alternative preferred embodiment, the present invention is directed to an adjustable corset for supporting at least a portion of a torso of a person. The corset may be free of all rigid, vertically-extending boning material.

In an alternative preferred embodiment, the present invention is directed to an adjustable corset for supporting at least a portion of a torso of a person.

In an alternative preferred embodiment, the present invention is directed to an article of clothing for supporting at least a portion of a torso of a person. The article of clothing may comprise an outer clothing layer and an inner clothing layer. The article of clothing may also comprise a plurality of support straps connected directly the lining and contained within the cavity. Each of the plurality of support straps may be made of an elastic material such that each of the plurality of support straps can be stretched and tightened around the torso of the person when each of the plurality of support straps are converted from the first, non-supporting position to the second, supporting position. Additionally, each of the plurality of support straps can be adjusted to a desired length and tightness independent from each other of the plurality of support straps when each of the plurality of straps is converted from the first, non-supporting position to the second, supporting position.

In an alternative preferred embodiment, the present invention is directed to an adjustable corset for supporting at least a portion of a torso of a person. The corset may comprise a body support sleeve configured to encircle the torso of the person wearing the corset. The corset may also comprise a plurality of support straps connected to an exterior of the body support sleeve. Each of the plurality of support straps may be made of an elastic material such that each of the plurality of support straps can be stretched and tightened around the torso of the person when each of the plurality of support straps are converted from the first, non-supporting position to the second, supporting position. Additionally, each of the plurality of support straps can be adjusted to a desired length and tightness independent from each other of the plurality of support straps when each of the plurality of straps is converted from the first, non-supporting position to the second, supporting position.

In an alternative preferred embodiment, the present invention is directed to an adjustable corset. The corset may not have any boning. Each of the horizontal straps of the corset that support and shape the user may be fastened by hooks and loops. The hooks and loops may be individual hooks and loops made of metal.

In an alternative preferred embodiment, the present invention is directed to an adjustable corset. The corset may not have any boning. Each of the horizontal straps of the corset that support and shape the user may be fastened by hooks and loops. The hooks and loops may be a hook and loop material, such as Velcro® or the like.

In an alternative preferred embodiment, the present invention is directed to an adjustable corset. The corset may be built directly into a dress or another garment covering the torso. The corset may be hidden under a zipper on the dress on the garment so that it is hidden from view.

In an alternative preferred embodiment, the present invention is directed to an adjustable corset. The elastic straps providing support and sculpting to the user's body may be directly connected to one another with no vertical space between so that no support sleeve is required to hold the corset's structure together.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings.

DETAILED DESCRIPTION OF THE PREFERRED EMBODIMENT

Figure 1:
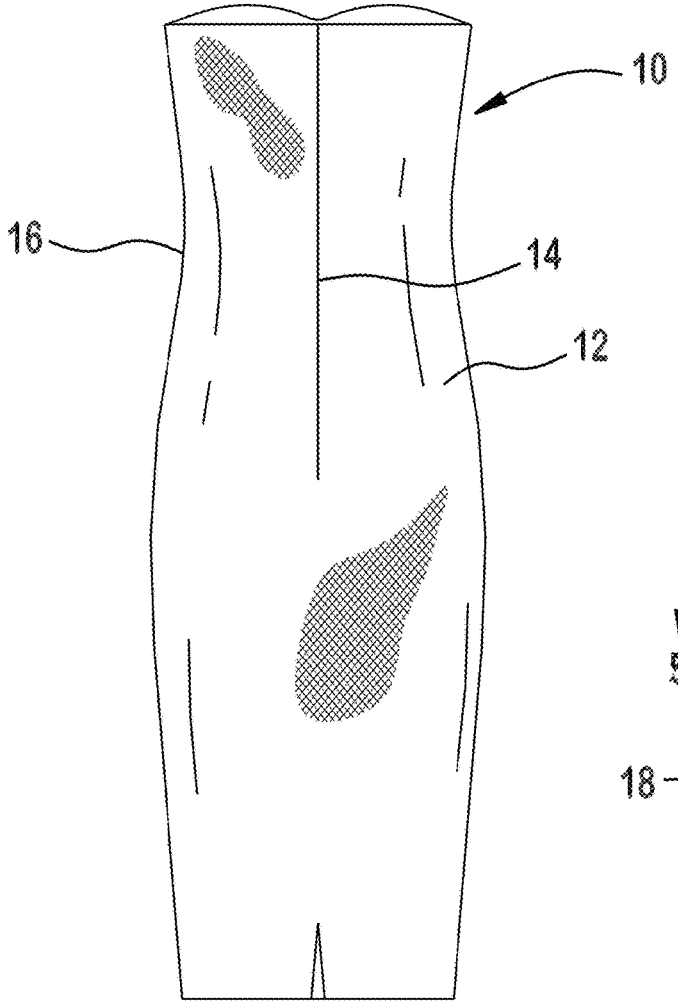
FIG. 1 is a front view of an article of clothing 10 for supporting at least a portion of a torso of a person. The article of clothing 10, in this example, is a dress. The article of clothing 10 has a back 12 with the seam 14 running vertically along a portion of the back 12. The article of clothing 10 is seen in a first, unsupported position 16 wherein the intra-clothing support device 30 (shown in FIG. 3) has not been engaged within the dress.

Certain terminology is used in the following description for convenience only and is not limiting. The words "right," "left," "up," and "down" designate the directions as they would be understood by a person facing drawings unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of the article of clothing 10 and/or the intra-clothing support device/corset 30. The terms "downward" and "upward refers to directions above (or away from) and below (or toward) the referenced surface of the article of clothing 10 and/or the intra-clothing support device/corset 30, unless specified otherwise. The terms "forward" and "front" refer to a direction in front of the referenced structure which faces the front of the device or forward from the device, and the term "rear" and back refers to a direction behind the reference structure which faces the back of the device or rearward from the device. The terms "axial" and "radial" refer to directions along torso 46, respectively. The terms "touching," "abutting," "against," and "contacting" when used in connection with two surfaces is defined as meaning "being positioned anywhere between actual touching of two surfaces to being in facing orientation and within a range of zero (0) to one (1) inches (or zero (0) to two point five four (2.54) centimeters) apart or less, which includes actual contact." Those of ordinary skill in the art will appreciate from this disclosure that skill in the art will appreciate from this disclosure that when a range is provided such as (for example) an angle/distance/number/weight/volume/spacing being between one (1 of the appropriate unit) and ten (10 of the appropriate units) that specific support is provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. By way of an additional example, a recitation in the claims and/or in portions of the specification of at least twenty (20°) degrees, provides specific literal support for any angle greater than twenty (20°) degrees, such as twenty-three (23°) degrees, thirty (30°) degrees, thirty-three-point five (33.5°) degrees, forty-five (45°) degrees, fifty-two (52°) degrees, or the like. The language "at least one of 'A', 'B', and 'C'," as used in the claims and in corresponding portions of the specification, means "any group having at least one 'A'; or any group having at least one 'B'; or any group having at least one 'C'; —and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "interior" (or inside, within, etc.), as used in the claims and corresponding portions of the specification means the area proximate to the center of the invention. The term "exterior" (our outside, etc.) similarly defines the area not in proximity to the center of the invention. Additionally, the words "a" and "one" are defined as including one or more of the referenced items unless specifically stated otherwise. The terminology includes the words specifically mentioned above, derivatives thereof, and words of similar import.

Referring generally to FIGS. 1-10, wherein like numerals indicate like elements throughout, preferred embodiments of an adjustable intra-clothing device/corset 30 for supporting at least a portion of a torso of a person and/or an article of clothing 10 for supporting at least a portion of a torso of a person are disclosed. More specifically, FIGS. 1-10 illustrate multiple preferred embodiments of the device/corset/clothing 10, 30. This device/corset/clothing 10, 30 greatly improves the ease with which a corset may be worn, a corset may be donned, and the comfortability and concealability of a corset. It is preferred, but not required, that the device/corset/clothing 10, 30 is lightweight, easy to don and doff, low-profile, and useable with a variety of dresses and other articles of clothing.

Figure 2:
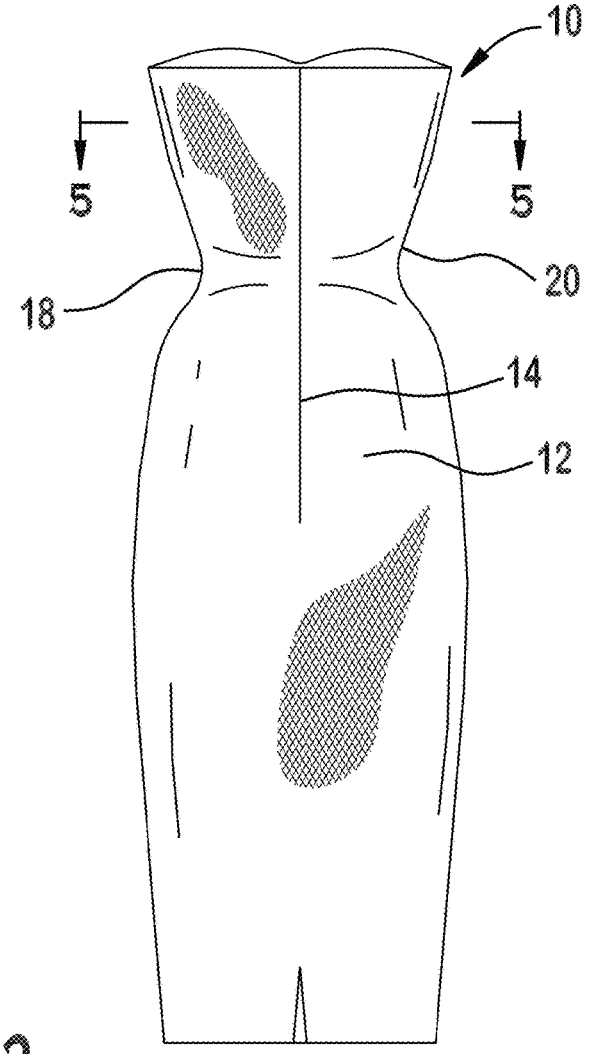
FIG. 2 is a front view of an article of clothing 10 for supporting at least a portion of a torso of a person. The article of clothing 10, in this example, is a dress. The article of clothing 10 has a back 12 with the seam 14 running vertically along a portion of the back 12. The article of clothing 10 is seen in a second, supported position 18 wherein the intra-clothing support device 30 (shown in FIG. 4) has been engaged within the dress. The sides of the dress are shown to have a natural curvature 20 matching that of the person wearing the dress.

Referring generally to FIGS. 1 and 2, an article of clothing 10 for supporting at least a portion of a torso of a person can be seen. The article of clothing 10 may comprise a dress. One of ordinary skill in the art will appreciate from this disclosure the article of clothing 10 may also be any other type of garment worn around the torso such as a t-shirt, a crop-top, a tank-top, a sweater, a sweatshirt, or the like, without departing from the scope of the present disclosure. One of ordinary skill in the art would appreciate from this disclosure at least a portion of torso includes any portion (i.e., the abdomen, the chest, and/or the whole torso), or all, of the body located between the shoulders/neck of a person to the waist of a person without departing from the scope of the present invention.

Referring still generally to FIGS. 1 and 2, the article of clothing 10 for supporting at least a portion of a torso of a person may comprise a seam 14 running vertically along a back 12 of the article of clothing 10. The seam 14 can be opened or closed by engaging a zipper 22. Opening the seam 14 may expose the corset/device 30 and allow a user to access the corset/device 30. Referring specifically to FIG. 1, the article of clothing 10 may be seen not tightened around the torso 46 of a person. This means that the plurality of straps 34 (shown in FIG. 3) may be in a first, unsupported position 36. Referring specifically to FIG. 2, the article of clothing 10 may be seen tightened around the torso 46 of a person. This means that the plurality of straps 34 (shown in FIG. 4) may be in a second, supported position 38. When the straps 34 are in the second, supported position 38, the article of clothing 10 may follow a curvature 20 of the torso 26 of the person. One of ordinary skill in the art would appreciate from this disclosure that the curvature 20 may be the natural curvature of the body (i.e., the resting shape of the body) or a sinched-in curvature of the body (i.e., the profile of the body being less than the resting shape) without departing from the scope of the present invention.

Figure 3:
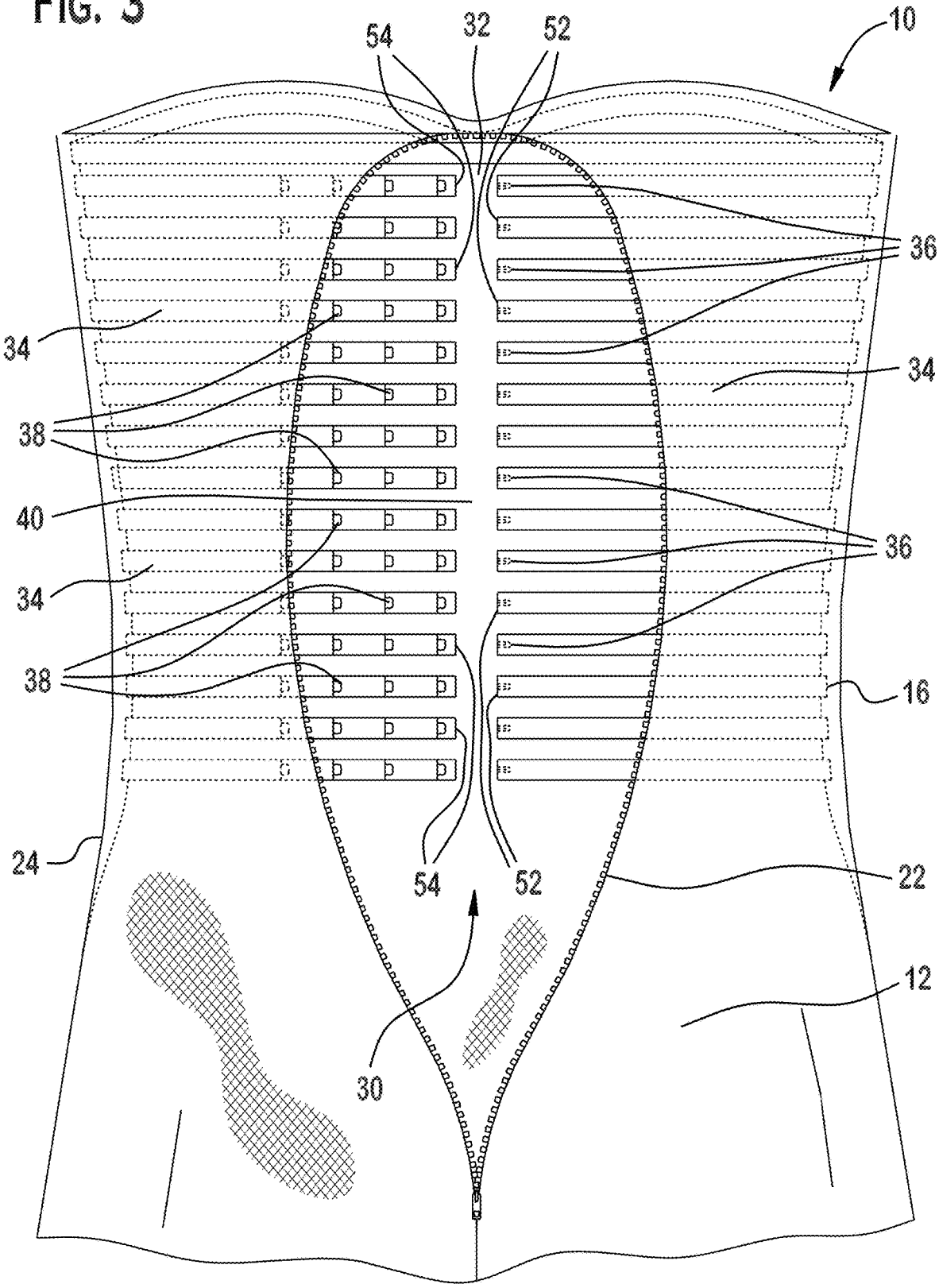
FIG. 3 is a partial, front view of the intra-clothing support device/corset 30 shown partially exposed through the opened seam 14. The seam 14 is opened by a zipper 22. Here, the intra-clothing support device 30 has a supporting sleeve 32 which wraps around the user's torso. The intra-clothing support device 30 also comprises a plurality of support straps 34 connected to a back 40 of the device 30. Each of the plurality of support straps 34 have a first end 54 and a second end 52. Located on the first end 54 is a first connecting member 36. Located on the second end 52 is a plurality of second connecting members 38. Because the first connecting members 36 of each of the plurality of support straps 34 are not engaged with corresponding second connecting members 38 of each of the plurality of support straps 34, each of the plurality of support straps 34 are shown in a first, unsupported position 16. Also, a cavity 24 is shown within the article of clothing 10. This cavity 24 allows the device 30 to be partially or wholly contained within the article of clothing 10.
Figure 4:
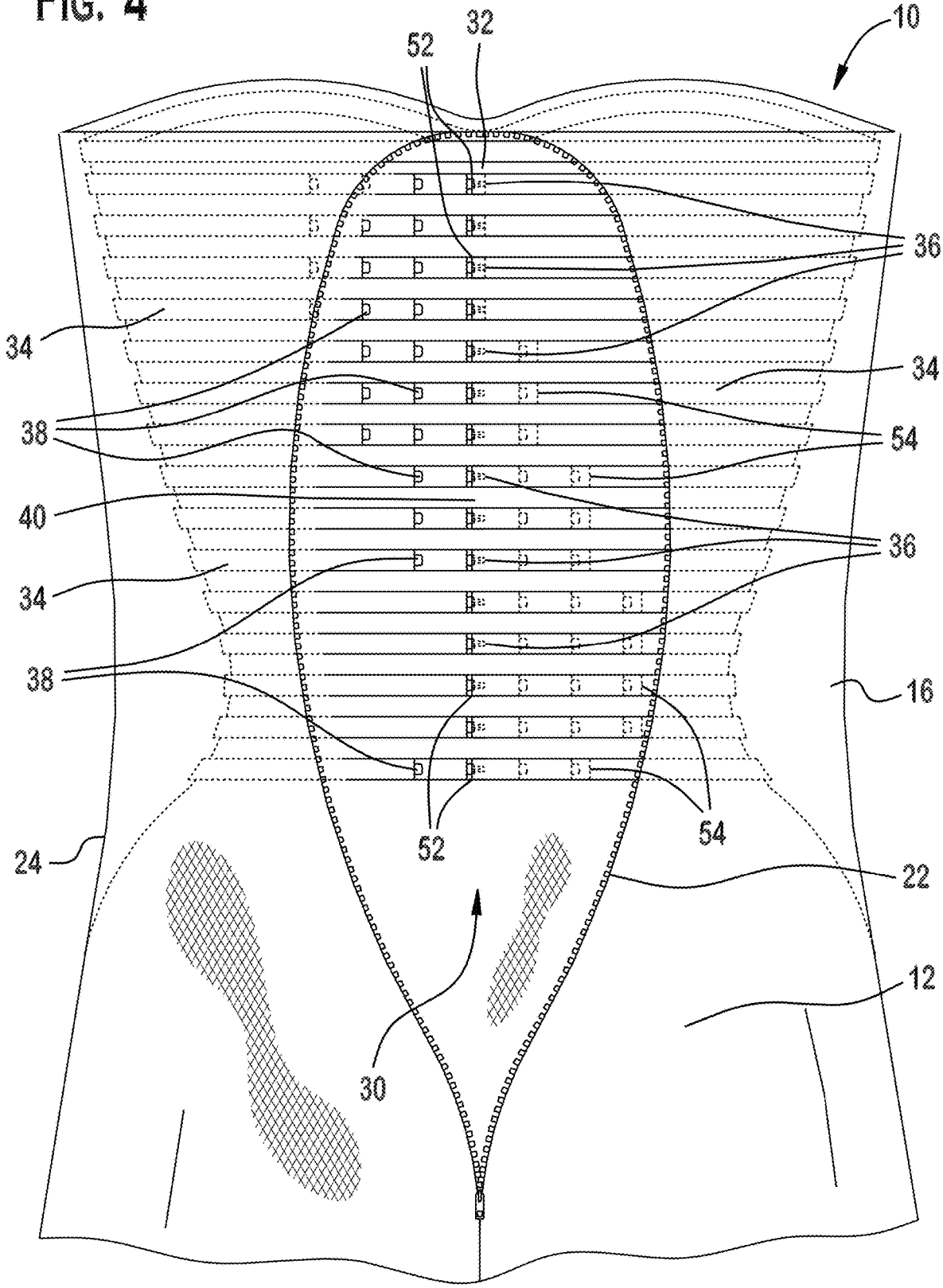
FIG. 4 is a partial, front view of the intra-clothing support device 30 shown partially exposed through the opened seam 14. The seam 14 is opened by a zipper 22. Here, the intra-clothing support device 30 has a supporting sleeve 32 which wraps around the user's torso. The intra-clothing support device 30 also comprises a plurality of support straps 34 connected to a back 40 of the device 30. Each of the plurality of support straps 34 have a first end 54 and a second end 52. Here, the first connecting members 36 of each of the plurality of support straps 34 are shown to be engaged with corresponding second connecting members 38 of each of the plurality of support straps 34. The engagement of each of the plurality of support straps 34 shows the device 30 in the second, supported position 18. By way of example, this figure shows different support straps 34 being tightened to different lengths by engaging the first connecting members 36 with different second connecting members 38 that are located on the same support strap 34. When a first connecting member 36 is connected to a second connecting member 38 that is located further away in the first, unsupported position 16, the result is that the support strap 34 will become tighter and a portion of the second end 52 will be covered by the first end 54.

Referring now generally to FIGS. 3 and 4, the device/corset 30 for supporting at least a portion of a torso 46 of a person can be seen within the article of clothing 10. One of ordinary skill in the art will appreciate form this disclosure that the article of clothing 10 is one embodiment of the present invention which includes the device/corset 30 while the device/corset 30 without the surrounding article of clothing 10 is also a preferred embodiment of the present invention.

Referring specifically to FIG. 3, the corset/device 30 can be seen through the opened seam 14 as the seam 14 may have been opened by engaging the zipper 22. One of ordinary skill in the art would appreciate from this disclosure that the zipper 22 may be substituted for any suitable closure device such a plurality of buttons or the like without departing from the scope of the present invention. The corset/device 30 may be free floating within a cavity 24 formed in the article of clothing 10. The cavity 24 may be formed between an outer layer 48 and an inner layer 50 (shown in FIG. 5) of the article of clothing 10. The corset/device 30 may comprise a supporting sleeve 32. The supporting sleeve 32 may be configured to wrap around the torso 46 of a person. The corset/device 30 may also comprise a plurality of support straps 34 connected to an exterior or an interior of the supporting sleeve 32. The embodiment shown in FIG. 3 shows the plurality of support shafts 34 being connected to the exterior of the supporting sleeve 32. Each of the plurality of straps 34 may have a first end 54 and a second end 52, opposite the first end 54. The first end 54 and the second end 52 may be free ends and may not be connected to the supporting sleeve 32. The first end 54 may comprise a first connecting member 36. The first connecting member 36 may comprise a hook. The second end 52 may comprise a plurality of second connecting members 38. The plurality of second connecting members 38 may comprise loops. The first connecting member 36 may be configured for engagement with the second connecting members 38. One of ordinary skill in the art would appreciate from this disclosure that any suitable device, such as hook and loop material like Velcro® (shown in FIG. 7), buttons and holes, or the like, for locking into engagement the first end 54 with the second end 52 may be substituted for the hooks and loops of the first connecting member 36 and the plurality of second connecting members 38 without departing from the scope of the present invention. One of ordinary skill in the art would also appreciate from this disclosure that the first connecting member 36 and the plurality of second connecting members 38 may be made of metal, ceramic, plastic, polymers, or any other suitable material without departing from the scope of the present invention.

Still referring to FIG. 3, the first connecting member 36 may be seen not engaged with the second connecting members 38. This means that each of the plurality of straps 34 may be in the first, unsupported position 16. This also means that the plurality of straps 34 may only partially wrap around the torso 46 of the person wearing the device/corset 30. Each of the plurality of support straps 34 may also be evenly vertically spaced from each other of the plurality of support straps 34. Each of the plurality of support straps 34 may also be horizontally extending around the torso 46 of the person. Each of the plurality of support straps 34 may also be parallel to each other of the plurality of support straps 34.

Referring now to FIG. 4, each of the plurality of support straps 34 can be seen in the second, supporting position 18. In the second, supporting position 18, a first connecting member 36 of a specific one of the plurality of support straps 34 may be engaged with any one of the plurality of second connecting members 38 of that specific one of the plurality of support straps 34. By engaging the first connecting member 36 of a specific one of the plurality of support straps 34 with different ones of the plurality of second connecting members, the tightness of that specific one of the plurality of support straps 34 may be freely adjustable. By way of example, the fourth one of the plurality of support straps 34 from the bottom seen in FIG. 4 is tighter than the tenth one of the plurality support straps 34 from the bottom. Because the first end 54 and the second end 52 may not be connecting to the support sleeve 32, the first end 54 may overlap and may be outside of the second end 52. A length of the first and second ends 52, 54 that are free and not connected to the support sleeve 32 may range from two (2) inches to twelve (12) inches. More preferably, the length of the first and second ends 52, 54 that are free and not connected to the support sleeve 32 may range from four (4) inches to eight (8) inches. Because each of the plurality of support straps 34 may be configured for engagement with itself, the relative tightness of each of the plurality of support straps 34 may differ from each other of the plurality of support straps 34.

Referring generally to FIGS. 3 and 4, each of the plurality of support straps 34 may be made of an elastic material. When each of the plurality of support straps 34 may be in the second, support position 18, the stretched elastic material of the support straps 34 may comprise a compressive force which may provide support and sculpting to the torso 46 of the person. One of ordinary skill in the art would appreciate from this disclosure that the material of the support straps 34 may be any suitably elastic, strong, supportive, and independently-fastenable material as desired without departing from the scope of the present invention. Due to the elastic and supportive nature of the horizontally-extending plurality of support straps 34, any and all rigid, inflexible, and vertically-extending boning is omitted from the present invention.

Figures 5, 6:
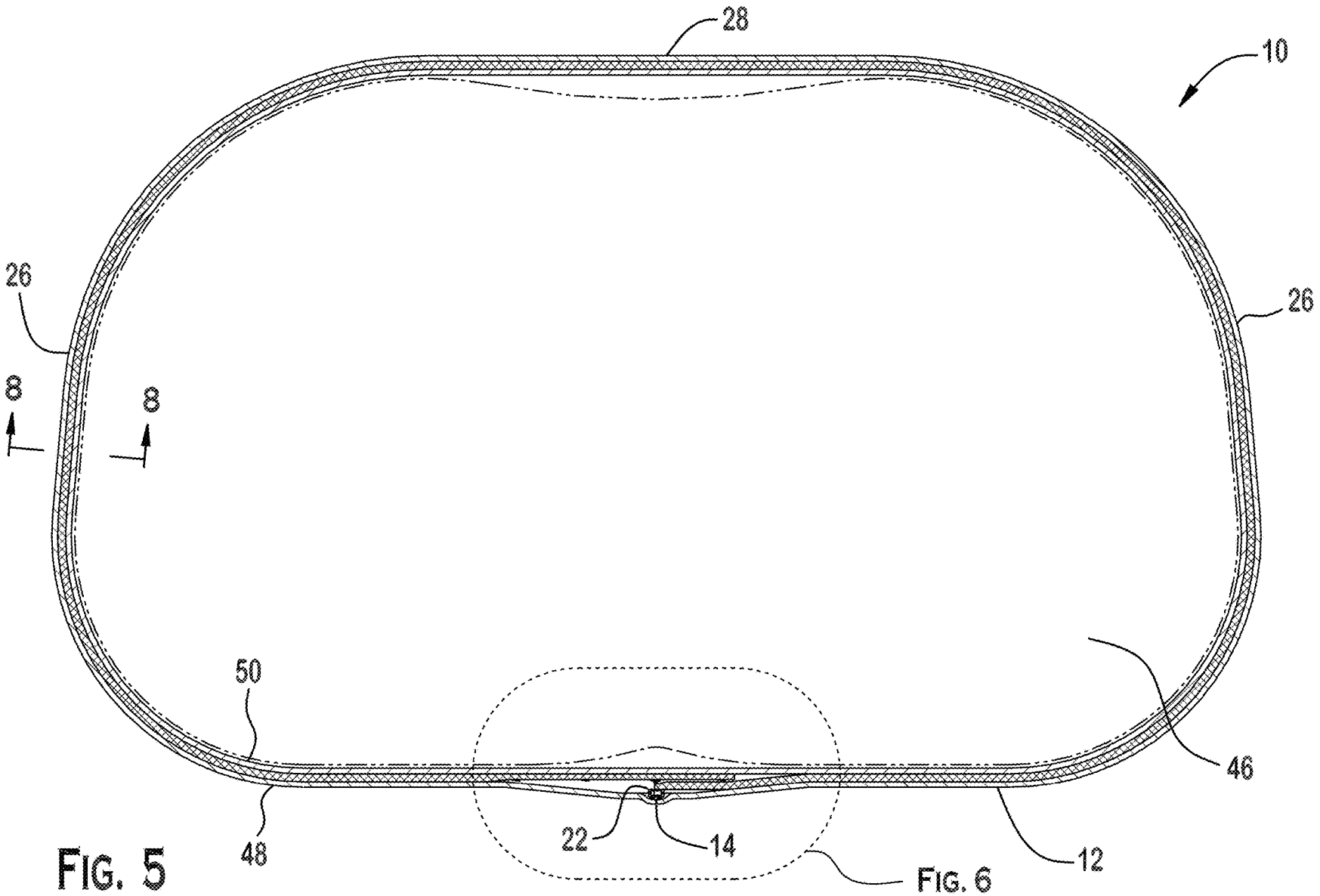
FIG. 5 is a top, cross-sectional view of the intra-clothing support device 30 shown within the article of clothing 10 of FIG. 2 as taken along the lines 5-5 of FIG. 2. Here, an outer layer 48 and an inner layer 50 of the article of clothing 10 can be seen. The corset device 30 can be seen located between the outer layer 48 and the inner layer 50. The corset 30 and the article of clothing 10 can be seen wrapping around a torso 46 of the person wearing the device 30. The sides 26, and front 28, of the article of clothing 10 are also seen in FIG. 5.
FIG. 6 is a close-up, partial, top cross-sectional view of the intra-clothing support device/corset 30 as seen in FIG. 5. This figure illustrates the layering of the article of clothing 10 and the device 30. In this embodiment, the supporting sleeve 32 is omitted as the supporting sleeve 32 exists as the material connecting adjacent support straps 34. Here, a support strap 34 can be seen in the second, supported position 18 as the first end 54 is layered over the second end 52 and a first connecting member 36 is engaged with one of the plurality of second connecting members 38. It can also be seen that the seam 14 is closed by the zipper 22 thereby covering the device 30 from the outside as the outer layer 48 is the outermost piece of material.
Figure 6:
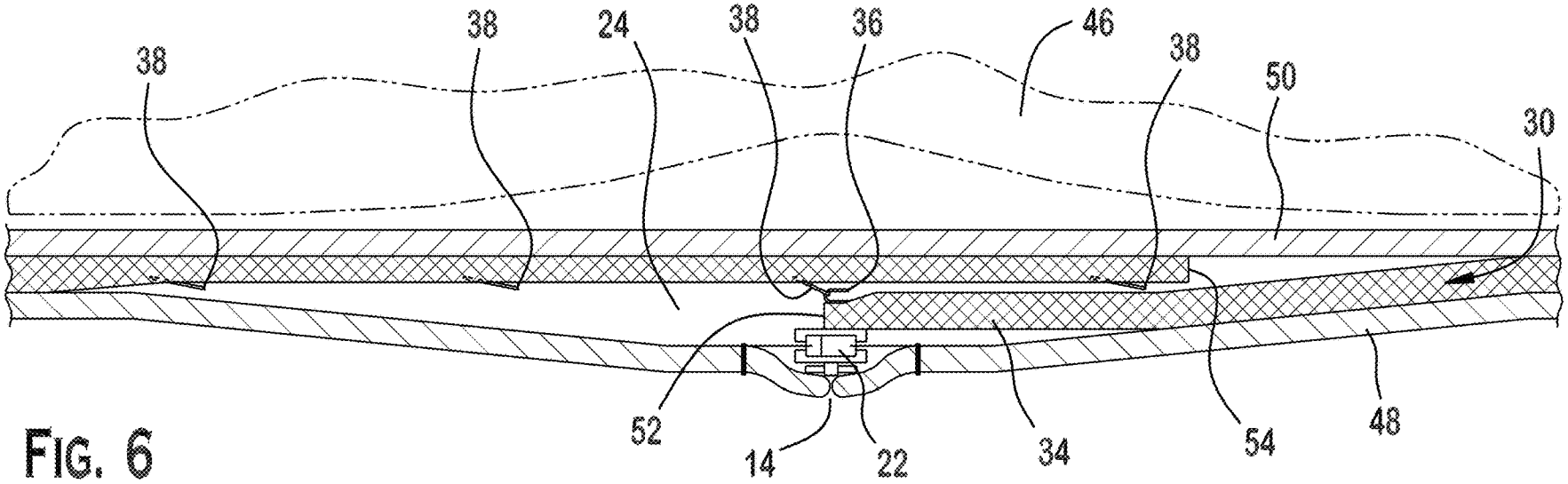

Referring now to FIG. 5, the entire device/corset 30 may be seen within the article of clothing 10. The article of clothing 10 may comprise an outer layer 48 and an inner layer 50. The device/corset 30 may be located between the outer and inner layers 48, 50 of the article of clothing 10. The article of clothing 10 and the device/corset 30 may also be seen wrapping around the torso 46 of the person wearing the device/corset 30. The device/corset 30 may be permanently sewn into the article of clothing 10, or the device/corset may be free-floating and freely insertable into and removable from the lining of the article of clothing 10. The sides 26 and the front 28 of the article of clothing 10 may also be seen in this figure. The layering the first end 54 over the second end 52 then the plurality of straps 34 are in the second, supporting position 18 may also be seen.

Referring now to FIG. 6, the engagement of the first connecting member 36 with one of the plurality of second connecting members 38 may be seen in more detail. The hook of the first connecting member 36 may be fed through the hole of one of the second connecting members 38. This engagement may lock the first connecting member 36 into engagement with the second connecting member 38. This embodiment of the present invention also highlights how the support sleeve 32 may comprise the material connecting adjacent support straps 34 without providing a constant sleeve or backing for all of the support straps 34 simultaneously. FIG. 6 may also highlight the layering of the device/corset 30 between the outer layer 48 and the inner layer 50 of article of clothing 10 in more detail. The zipper 22 closing the seam 14 may also be seen in greater detail.

Figure 7:
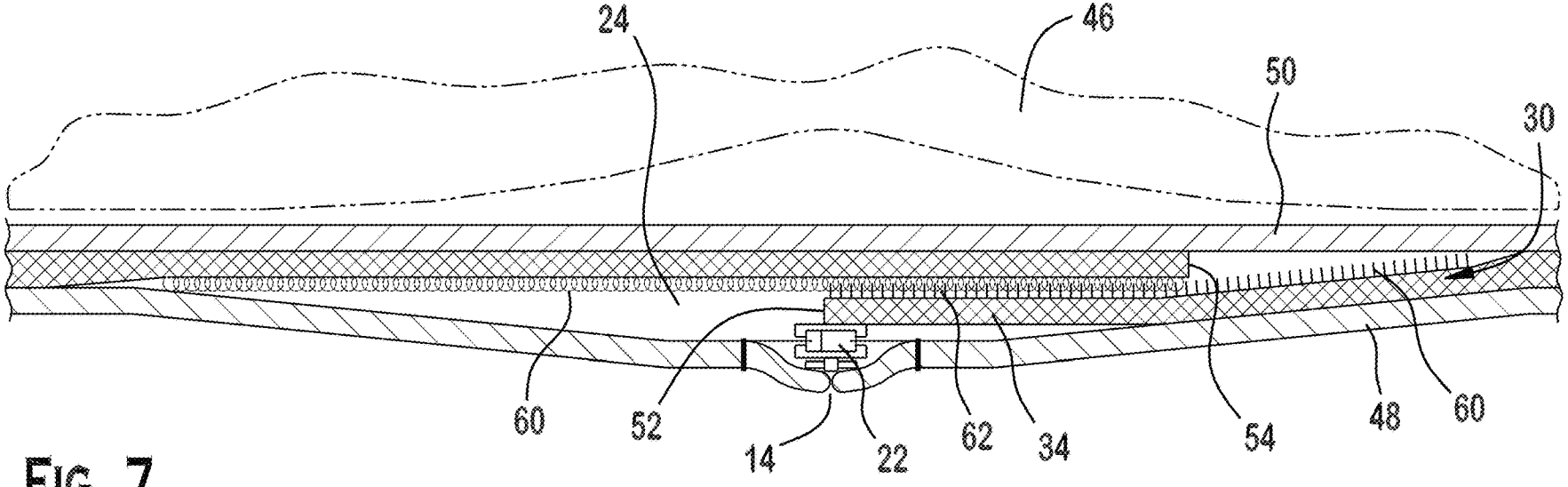
FIG. 7 is a close-up, partial, top cross-sectional view of an alternative preferred embodiment of the intra-clothing support device/corset 30 as seen in FIG. 6. Here, the first and second connecting members 36, 38 have been substituted for hook and loop material 60, such as Velcro®. The engagement of the hook and look material 60 is shown at reference numeral 62.

Referring now to FIG. 7, an alternative preferred embodiment of the device/corset 30 as seen in FIG. 6 is shown. Here, the first and second connecting members 36, 38 may be replaced by a length of hook and loop material, such as Velcro®. This may allow for the adjustability of each of the plurality of support 34 to be increased as the engagement of the first and second connecting members 36, 38 is no longer limited to the number of second connecting members 38 located on the second end 52 of each of the plurality of support straps 34.

Figure 8:
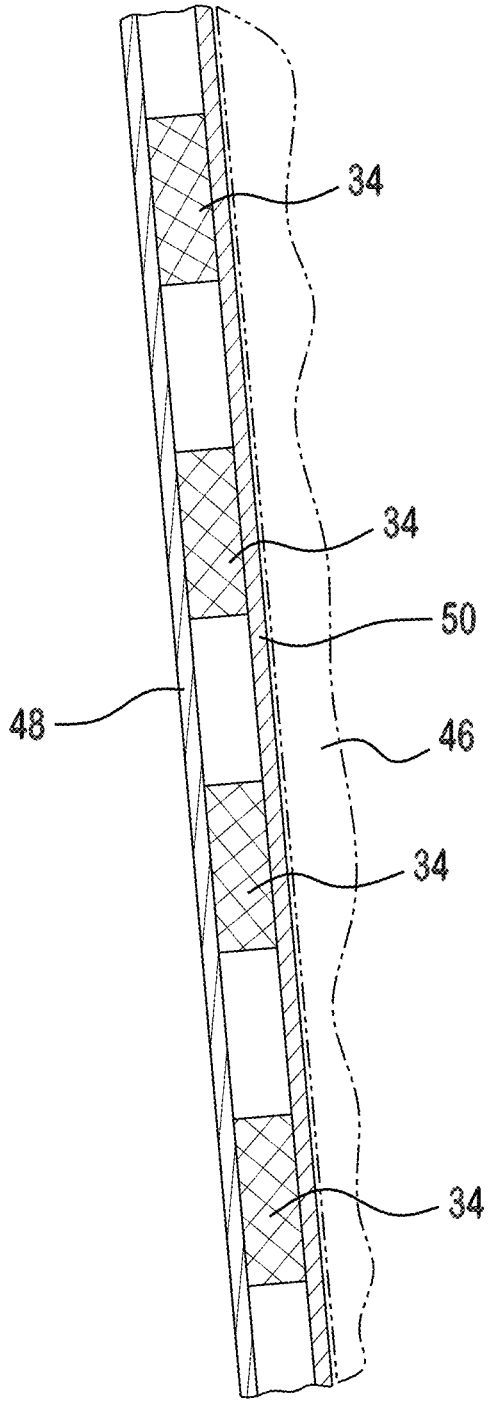
FIG. 8 is a front, cross-sectional view of the intra-clothing support device 30 shown within the article of clothing 10 of FIG. 5 as taken along the lines 8-8 of FIG. 5. Here, it can be seen that the device 30 is free-floating in between the outer layer 48 and the inner layer 50 of the article of clothing 10. It can also be seen how each of the plurality of straps 34 are evenly vertically spaced from one another. Free floating can mean that after the corset is secured to the person the dress can move up and down for the best fit. Alternatively, free floating can mean that the corset can move up and down relative to the height of the clothing prior to securing the corset to the user at which point the corset and the dress are vertically positioned on the user.

Referring now to FIG. 8, an alternative preferred embodiment of the article of clothing 10 with the corset/device 30 may be seen. Here, the supporting sleeve 32 may be omitted and the plurality of support straps 34 may be attached directly to the inner layer 50 of the article of clothing 10. FIG. 8 also highlights the vertical spacing between each of the plurality of support straps 34. One of ordinary skill in the art will appreciate from this disclosure that the spacing between each of the plurality of support straps 34 may be even, as shown, or the spacing between each of the plurality of support straps 34 may be uneven, without departing from the scope of the present invention.

Figure 9:
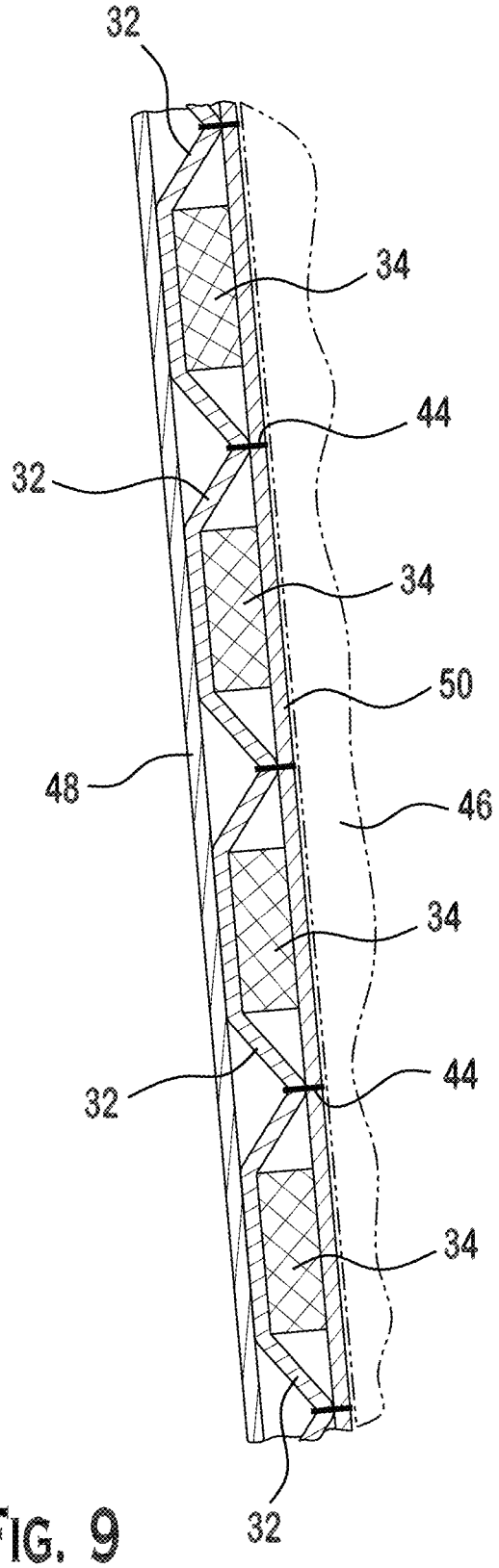
FIG. 9 is a front, cross-sectional view of an alternative preferred embodiment of the intra-clothing support device 30 shown within the article of clothing 10 as seen in FIG. 8. In this alternative preferred embodiment, the supporting sleeve 32 is located on the outside of the plurality of straps 34. The sections of the supporting sleeve 32 located vertically between each of the plurality of straps 34 are connecting to the inner layer 50 by stitches 44.

Referring now to FIG. 9, an alternative preferred embodiment of the article of clothing 10 with the corset/device 30 seen in FIG. 8 is shown. In this embodiment, the support sleeve 32 may be located on the outside of the plurality of support straps 34. The support sleeve 32 may be permanently connected to the inner layer 50 of the article of clothing 10. The support sleeve 32 may be connected to the inner layer 50 by stitches 44 located in the spaces between adjacent support straps 34. In this way, the majority of the plurality of support straps 34 may be concealed beneath the supporting sleeve 32. The plurality of support straps 34 may also be free floating within the slots formed between the support sleeve 32 and the inner layer 50.

Figure 10:
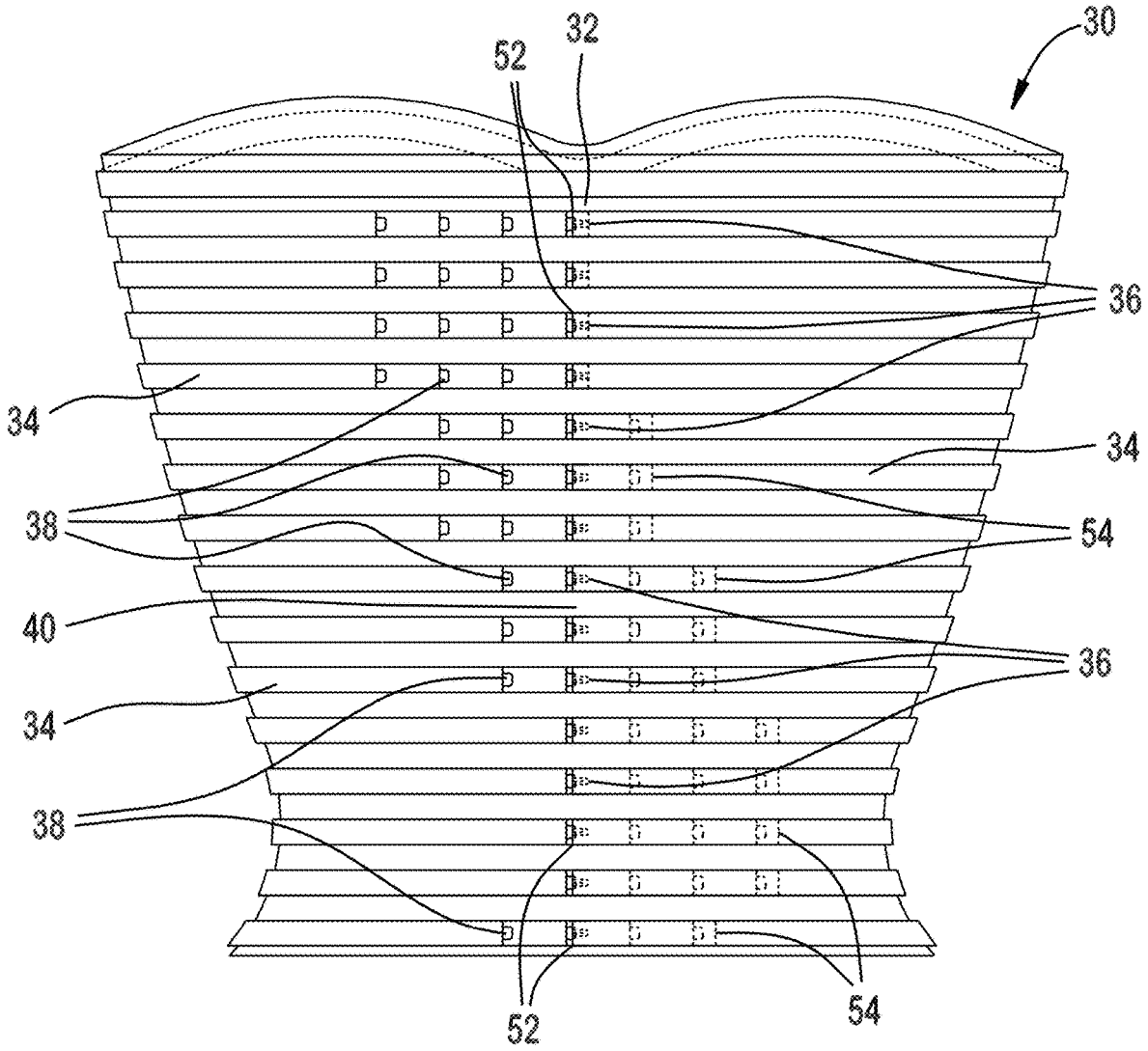
FIG. 10 is a front view of an alternative preferred embodiment of the corset 30. In this embodiment, the corset 30 is not located within the lining of an article of clothing or a dress. This corset 30 can be worn underneath clothing. This embodiment of the corset 30 can also be freely slid into the lining of a dress or other article of clothing. This alternative embodiment of the corset 30 can also be worn as clothing by itself without further articles of clothing being layered over the top it or underneath it.

Referring now to FIG. 10, an alternative preferred embodiment of the device/corset 30 may be seen. Here, the corset/device 30 may be free-standing and not located within the lining of an article of clothing 10. The corset/device 30 may have similar elements to that of previously disclosed embodiments. However, one of ordinary skill in the art will appreciate from this disclosure that the corset/device 30 shown in FIG. 10 may be worn on it's own or strictly under other garments without departing from the scope of the present invention. The device/corset 30 shown in FIG. 10 may also be configured for free insertion into, and removal from, the lining an article of clothing 10.

One advantage of the article of clothing 10 including the device/corset 30 for supporting at least a portion of a torso of person may be to provide support and sculpting to the body and figure of a person using the present invention. This support and sculpting may be provided by a plurality of elastic supports straps 34 instead of the rigid, vertically-extending boning used for traditional corsets.

Another advantage of the article of clothing 10 including the device/corset 30 for supporting at least a portion of a torso of person may be to allow the person using the device to tighten the device according to the torso's natural curvature instead of having the curvature predefined by rigid boning used in traditional corsets. Because each of the plurality of straps 34 can be tightened independently from each other of the plurality of straps 34, the different varied lengths can allow the device/corset 30 to conform more naturally to the user.

Another advantage of the article of clothing 10 including the device/corset 30 for supporting at least a portion of a torso of person may be to allow the user to fasten and engage the connecting members 36, 38 without assistance. The nature of the hooks and plurality of loops, or Velcro®, may allow each of plurality of support straps 34 to be individually fastened by the person wearing the device/corset 30 without the complicated lacing employed by traditional corsets.

One of ordinary skill in the art will appreciate from this disclosure that the various components and elements of the present invention may be constructed of any suitably strong, wear-resistant, flexible (where desired), and inexpensive metals, polymers, alloys, plastics, fabrics, and other materials without departing from the scope of the present invention.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed, described in the specification, and/or shown in the figures. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. An article of clothing for supporting at least a portion of a torso of a person, comprising:

an outer clothing layer, an inner lining clothing layer, a supporting sleeve attached to the inner clothing layer and having first and second sleeve ends configured to wrap around the torso of the person; and a plurality of connecting members positioned on the supporting sleeve to allow the supporting sleeve to be secured at an optimal position for the person while being covered by the article of clothing.

2. The article of clothing of claim 1, wherein the first and second sleeve ends comprise a plurality of support straps connected to an exterior of the supporting sleeve and configured to at least partially wrap around the torso of the person, the plurality of straps being parallel to one another and vertically spaced from one another, wherein each of the plurality of support straps has a first end and a second end and being configurable in a first, non-supporting position in which the first end is detached from the second end and a second, supporting position in which the first end is engaged with the second end, wherein the first end of each of the plurality of support straps is configured to partially overlap the second end when the plurality of straps are in the second, supporting position.

3. The article of clothing of claim 2, wherein the plurality of connecting members comprises a first connecting member and a plurality of second connecting members, the first end comprising the first connecting member and the second end comprising the plurality of second connecting members, the first connecting member being configured for engagement with any one of the plurality of second connecting members to convert each of the plurality of straps to the second, supporting position, the engagement of the first and second connecting members preventing relative movement between the first and second ends.

4. The article of clothing of claim 3, wherein the first connecting member comprises a hook and the plurality of second connecting members comprise loops.

5. The article of clothing of claim 1, wherein each of the plurality of support straps are made of an elastic material such that each of the plurality of support straps are stretched and tightened around the torso of the person when each of the plurality of support straps are converted from the first, non-supporting position to the second, supporting position.

6. The article of clothing of claim 1, wherein each of the plurality of support straps is adjustable to a desired length and tightness independent from each other of the plurality of support straps when each of the plurality of straps is converted from the first, non-supporting position to the second, supporting position.

7. The article of clothing of claim 1, wherein the device is removably insertable into, and free-floating within an inner lining layer an article of clothing.

8. The article of clothing of claim 1, wherein the plurality of straps are evenly vertically spaced from one another.

9. The article of clothing of claim 1, wherein the device is concealable within the lining of the article of clothing by engaging a zipper on a back of the article of clothing.

10. An article of clothing for supporting at least a portion of a torso of a person, comprising:

an outer clothing layer, an inner clothing layer forming a lining, the outer and inner clothing layers forming a cavity located therebetween, and an adjustable internal clothing layer located within the cavity, comprising:

a supporting sleeve configured to wrap around the torso of the person; and a plurality of support straps connected to an exterior of the supporting sleeve and configured to at least partially wrap around the torso of the person, the plurality of straps being parallel to one another and vertically spaced from one another, wherein the adjustable internal clothing layer is free within the article of clothing such that the adjustable internal clothing layer can slide up and down within the cavity such that the vertical position of the adjustable internal clothing relative to the height of the article of clothing can be adjusted, wherein each of the plurality of support straps has a first end and a second end and being configurable in a first, non-supporting position in which the first end is detached from the second end and a second, supporting position in which the first end is engaged with the second end.

11. The article of clothing of claim 10, wherein the adjustable internal clothing layer is free-floating within the cavity and removable from the article of clothing.

12. An article of clothing and an adjustable corset for supporting at least a portion of a torso of a person, comprising:

an article of clothing having an outer clothing layer and an inner clothing layer, the adjustable corset comprising a body support sleeve attached to the inner clothing layer and having first and second sleeve ends configured to encircle a portion of the torso of the person wearing the article of clothing, a plurality connecting members positioned on the supporting sleeve to allow the supporting sleeve to be secured at an optimal position for the person while being covered by the article of clothing.

13. The article of clothing and the adjustable corset of claim 12, wherein the first and second sleeve ends comprise a plurality of support straps connected to an exterior of the body support sleeve and configured to at least partially wrap around the torso of the person, the plurality of straps being parallel to one another and evenly vertically spaced from one another, wherein each of the plurality of support straps having a first end and a second end and being configurable in a first, non-supporting position in which the first end is detached from the second end and a second, supporting position in which the first end is engaged with the second end.

14. The article of clothing and the adjustable corset of claim 12, wherein the adjustable corset supports and sculpts the torso of the person to the person's desired figure.

15. The article of clothing and the adjustable corset of claim 12, wherein the corset is free of all rigid, vertically-extending boning material.

16. The article of clothing of claim 3, wherein the adjustable intra-clothing device is free of any boning.

17. The article of clothing of claim 16, wherein the adjustable intra-clothing device is free of any lacing.

18. The article of clothing of claim 17, wherein the plurality of straps are elastic and wherein a compressive force provided by the adjustable intra-clothing device is entirely provided by the elasticity of the plurality of straps and not due to the tightening of a non-elastic band which is fixed in position around the person.

19. The article of clothing of claim 10, wherein each of the plurality of support straps are made of an elastic material such that each of the plurality of support straps are stretched and tightened around the torso of the person when each of the plurality of support straps are converted from the first, non-supporting position to the second, supporting position, and wherein each of the plurality of support straps is adjustable to a desired length and tightness independent from each other of the plurality of support straps when each of the plurality of straps is converted from the first, non-supporting position to the second, supporting position.

20. The article of clothing and the adjustable corset of claim 13, wherein each of the plurality of support straps are made of an elastic material such that each of the plurality of support straps are stretched and tightened around the torso of the person when each of the plurality of support straps are converted from the first, non-supporting position to the second, supporting position, and wherein each of the plurality of support straps is adjustable to a desired length and tightness independent from each other of the plurality of support straps when each of the plurality of straps is converted from the first, non-supporting position to the second, supporting position.

* * * * *